US005845721A

United States Patent [19]

Southard

[11] Patent Number: 5,845,721

[45] Date of Patent: Dec. 8, 1998

[54] DRILLING DEVICE AND METHOD OF DRILLING WELLS

[76] Inventor: Robert Charles Southard, P.O. Box 121, Dix, Nebr. 69133

[21] Appl. No.: 800,582

[22] Filed: Feb. 18, 1997

[51] Int. Cl.[6] ..... E21B 7/00

[52] U.S. Cl. ..... 175/57; 175/92; 175/106; 408/130

[58] Field of Search ..... 175/57, 61, 92, 175/106, 101, 173; 408/130, 124

[56] References Cited

U.S. PATENT DOCUMENTS

| | | | |
|---|---|---|---|
| 3,322,466 | 5/1967 | Mennekes | 175/106 X |
| 3,335,806 | 8/1967 | Caro | 175/106 |
| 3,441,096 | 4/1969 | Lautsch | 175/106 X |
| 3,491,843 | 1/1970 | Rodriguez | 175/106 X |
| 3,517,759 | 6/1970 | Crumbo | 175/106 X |
| 3,669,199 | 6/1972 | Cullen et al. | 175/106 |
| 3,964,555 | 6/1976 | Franklin | 175/106 X |
| 4,004,642 | 1/1977 | Dardick | 175/106 X |
| 4,683,964 | 8/1987 | Wenzel | 175/107 |
| 4,744,426 | 5/1988 | Reed | 175/106 X |
| 5,472,057 | 12/1995 | Winfree | 175/101 X |

OTHER PUBLICATIONS

Journal of Petroleum Technology; pp. 1104, 1106 & 1108; Bit Design Key to Improved Performance; Dec. 1996.

Journal of Petroleum Technology; pp. 1109 & 1110; "Enhance Soft–Formation Performance with Matrix Bit": Dec. 1996.

Journal of Petroleum Technology; p. 1111: "Drilling and Underreaming Simultaneously: A Cost–Effective Option"; Dec. 1996.

Journal of Petroleum Technology; pp. 1112 & 1115: "Bit Modifications Save Money. Time Offshore Sarawak"; Dec. 1996.

*Primary Examiner*—Roger Schoeppel

*Attorney, Agent, or Firm*—Domingue, Delaune & Waddell

[57] ABSTRACT

A device for drilling a well bore is disclosed. The invention includes having a tubular string with a motor means for generating a rotative force. The device further includes an inner drilling device adapted to the motor means and an outer drilling device concentrically arranged about the inner drilling device. The device still further includes a planetary gear system adapted for imparting the rotation generated from the motor means to the outer drilling device. In one embodiment, the motor member has a shaft extending therefrom, with the shaft being operatively connected with the inner drilling device, and wherein the shaft has a plurality of shaft splines thereon formed to cooperate with the planetary gear system. A method of drilling a well bore with the novel drilling device is also disclosed. The method includes rotating a power shaft from the drilling motor in a first direction which in turn imparts rotation to the inner drilling device and a counter rotation to the outer drilling device via the planetary gear systems.

22 Claims, 5 Drawing Sheets

DRILLING DEVICE AND METHOD OF DRILLING WELLS

BACKGROUND OF THE INVENTION

This invention relates to a novel drilling device and method of drilling a well. More particularly, but not by way of limitation, this invention relates to a non-reactive torque device that contains an inner bit and a counter-rotating outer bit. The invention also describes a method of drilling the well. The novel device will significantly reduce the reactive torque generated during the drilling phase.

In the search for oil and gas, operators have utilized various types of devices in order to drill wells. Operators are continually searching for ways to drill the wells faster and more economically. Traditionally, a drill string was used to drill wells. The drill string would have attached thereto a drill bit. In order to drill the well, the driller would cause the drill string to rotate which would in turn cause the bit to rotate, and hence, drill the well. Over the years, various types of drill strings have been developed in order to drill directional, or inclined, well bores.

Further, different types of bottom hole assemblies have also been developed in order to drill these wells. Thus, a typical directional drill string may contain a bottom hole assembly which includes: a bit, bent sub, drilling motor, and measurement-while-drilling surveying and logging tools. With this type of bottom hole assembly, the drill string ideally is held stationary with respect to rotation. The drilling motor generates rotation of the bit via circulation of the drilling fluid through the drilling motor as is well understood by those of ordinary skill in the art. With the drill string held stationary with respect to rotation, the well is drilled in the desired, controlled direction of the bend in the bent sub.

A common problem with this type of drilling assembly is the torque generated by the bit. The bit torque generates an equal and opposite reactive torque that is transferred from the motor into the bottom hole assembly and drill string, causing it to counter-rotate, relative to the bit. Further, the reactive torque, and hence the drill string counter-rotation, varies due to drilling conditions, such as the weight applied to the bit, properties of the rock being drilled, and hole condition, which all vary independently of each other. As the bent sub is part of the bottom hole assembly being counter-rotated, the direction in which the well is being drilled changes with the changes in reactive torque.

As a result, the directional driller is required to make numerous surface adjustments of the drill string, and hence the bent sub, to maintain drilling in the desired direction. These numerous adjustments cost valuable rig time and reduce the efficiency of the drilling operation. By eliminating, or greatly reducing, the reactive torque in the bottom hole assembly and drill string, drilling can proceed unabated in the desired direction, saving valuable rig time. Other benefits of eliminating, or reducing, reactive torque include the ability to use more powerful motors and more weight on bit to increase drilling rates and drilling a smoother, less tortuous borehole for running logging tools and setting casing.

Therefore, there is a need for a device that can reduce the reactive torque generated by a drilling motor while drilling wells. There is also a need for a device that will drill wells faster and more efficiently. There is also a need for a drilling assembly that can be steered more accurately and more responsively.

SUMMARY OF THE INVENTION

A device for drilling a well bore is disclosed. The invention includes having a tubular string with a motor means for generating a rotative force. The device further includes an inner bit member adapted to the motor means and an outer bit member concentrically arranged about the inner bit. The device further comprises a planetary gear system adapted for imparting the rotation generated from the motor means to the outer bit member.

In one embodiment, the motor member has a shaft extending therefrom, with the shaft being operatively connected with the inner bit member, and wherein the shaft has a plurality of shaft splines thereon formed to cooperate with the planetary gear system. The planetary gear may comprise a plurality of cogs formed on the inner diameter of the outer bit member, and a first pinion operatively associated with the cogs and wherein the first pinion engages the shaft splines so that rotative movement of the shaft splines is imparted to the cogs.

In the preferred embodiment, the device contains a second, third, and fourth pinion that are all operatively associated with the cogs and wherein the second pinion, third pinion, and fourth pinion engages the shaft splines so that rotative movement of the shaft spline is imparted to the cogs.

The device may further comprise a bearing assembly having a first end and second end, with the second end of the motor means being rotably associated with the first end of the bearing assembly. In one embodiment, the inner bit member and the outer bit member are adapted to form a chamber and wherein the device will also contain a sealing means for sealing communication from the inner diameter of the first bit into the chamber, and a lubricant compound is then placed within the chamber.

In one embodiment, a first set of cutter teeth is place on the inner bit and positioned to drill the bore hole in a first rotation (clockwise looking down at the bottom of the hole), and a second set of cutter teeth is placed on the second bit and positioned to drill the bore hole in a counter rotation (counterclockwise looking down at the bottom of the hole). Also, in the preferred embodiment, the inner bit is adapted to be offset relative to the outer bit.

A planetary gear system for imparting rotation to a bit for drilling a bore hole is also disclosed. Generally, the gear system comprises a motor member adapted for generating a rotative force to a power shaft, the power shaft having a plurality of shaft splines formed thereon. The system further contains a first pinion operatively associated with the shaft splines and a housing. The power shaft and pinion are contained within said housing.

In the preferred embodiment, the gear system includes a plurality of housing cogs formed on the internal diameter of the housing and wherein the first pinion transfers rotative movement from the shaft to the housing. The planetary gear system may also include a second pinion operatively associated with the shaft spline; and wherein the power shaft exerts a reactive torque in a first direction and the housing exerts a reactive torque in an opposite direction.

A method of drilling a well bore with a drilling assembly having a drilling motor, and a bit member, is also disclosed. The bit member includes an inner bit and a concentric outer bit. The method comprises rotating a power shaft from the drilling motor in a first direction which in turn imparts rotation to the inner bit in the first direction. The bore hole will be drilled with the inner bit, and with the boring, a first reactive torque in the inner bit is created.

The method would further include transferring the rotation of the power shaft to a pinion located within the gear system of the drilling assembly which in turn transfers the rotation of the pinion to a plurality of cogs operatively associated with the outer bit. Next, the bore hole is drilled utilizing the outer bit, and with the boring, a second reactive torque in the outer bit is created. In the preferred embodiment, the inner bit and the outer bit are drilling at the same time.

An advantage of the present invention is that the novel drilling device will greatly reduce or eliminate the reactive torque generated by a drilling motor while drilling a bore hole due to the offsetting torques created by the inner bit and the outer bit. Another advantage of this non-reactive torque condition is that re-orientation of the bit while drilling through formation changes, weight-on-bit changes, sticking or slipping of the drill string, rotating the drill string or making connections will be minimized. Yet another advantage is that without the reactive torque, a minimum amount of adjustments in path and projectory would have to be made.

Still yet another advantage is that during drilling, the drilled hole will experience less tortuosity allowing logging tools and casing to be run easier. Another advantage is that since the bottom hole assembly will not be striking the bore hole walls in as much frequency, more powerful motors can be run that would increase rate of penetration. Still yet another advantage includes generating a bore hole that is better to log within. Another advantage is the saving of valuable rig time.

A feature of the present drilling device includes having an inner bit and concentric outer bit operatively associated therewith. Another feature includes use of a novel planetary gear system. Yet another feature includes having splines formed on the power shaft that engages a pinion wheel.

Still yet another feature includes use of the cogs that are operatively associated with outer bit and that engage the pinion so that rotation may be imparted to the outer bit. Another feature includes that in one embodiment the bit is designed so that the cutting areas of the bit and gear ratios are such during drilling that the torque of the inner bit and the torque of the outer bit basically cancel each other out.

DETAILED DESCRIPTION OF THE PREFERRED EMBODIMENTS

Figure 1:
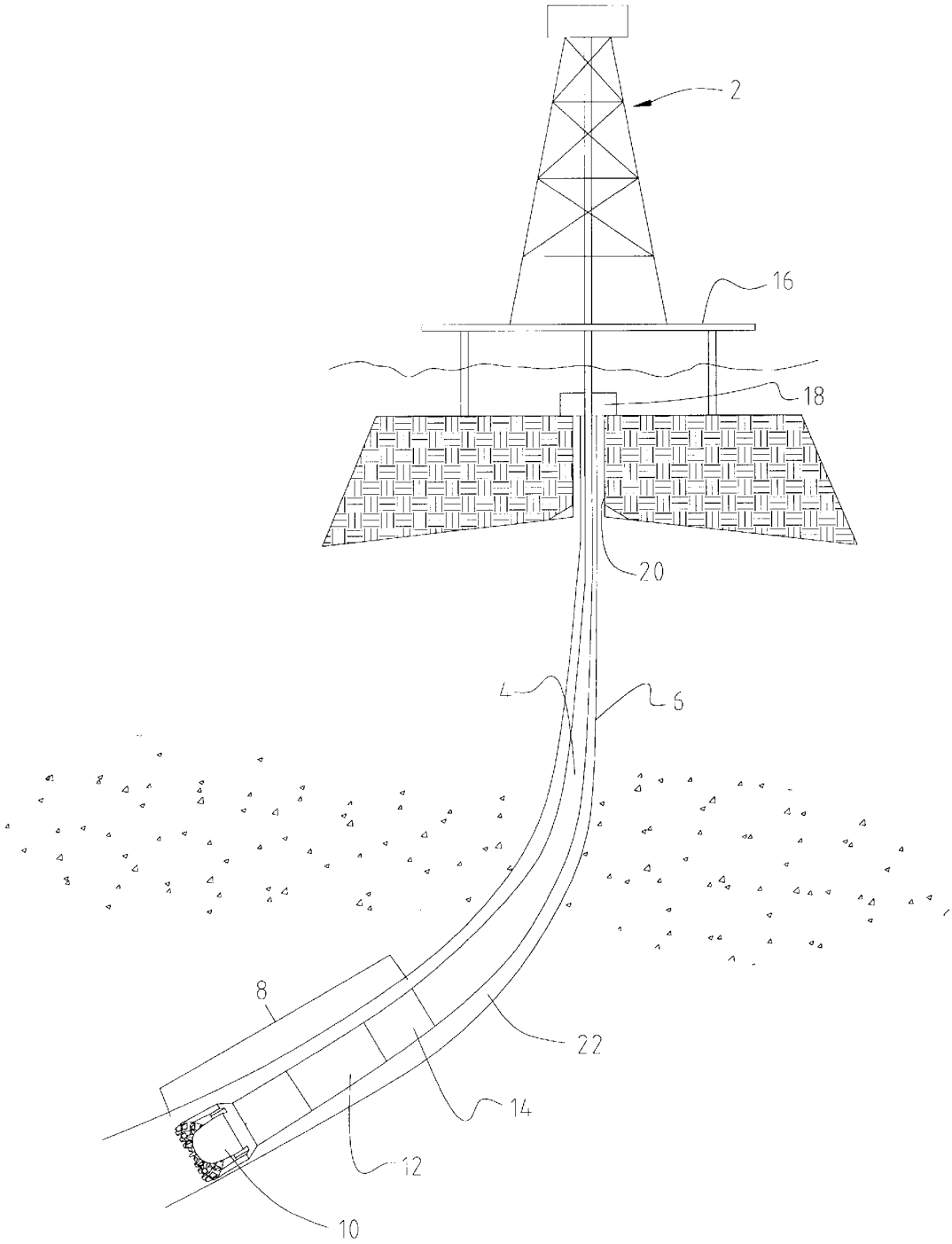
FIG. 1 depicts a drilling rig with a work string extending therefrom in a deviated well.

Referring now to FIG. 1, a typical drilling rig 2 with a work string 4 extending therefrom in a deviated well 6. As depicted in FIG. 1, the work string 4 will have a bottom hole drilling assembly 8 that includes the novel drilling device 10 that extends from a drilling motor 12. The drilling assembly 8 may also include a measurement while drilling member 14 and bent sub 15.

As is well understood by those of ordinary skill in the art, the drilling rig 2 may be situated on a platform 16 that is positioned on the ocean floor. The work string 4 extends into the well 6. FIG. 1 also depicts a sub-sea blow-out-preventors 18 and the surface casing 20. An annulus area 22 is formed between the work string and well 6.

Figure 2:
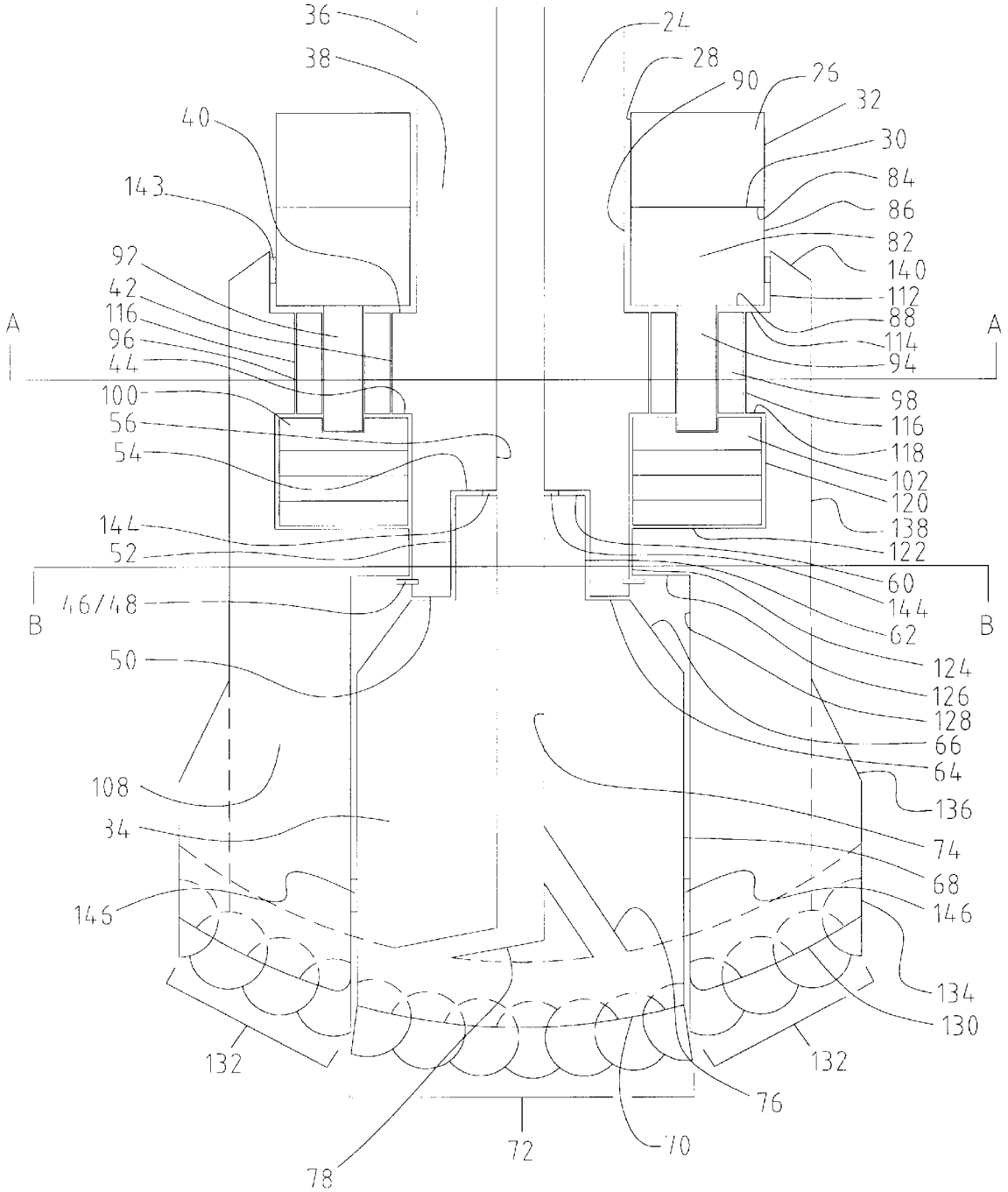
FIG. 2 is a sectional view of the preferred embodiment of the present novel bit.

Referring now to FIG. 2, a sectional view of the preferred embodiment of the present novel bit 10 is disclosed. It should be noted that like numbers appearing throughout the various figures represent like components. As noted earlier, the drilling motor 12 will be included. A typical drilling motor 12 is a positive displacement motor (PDM) and is commercially available from the Anadrill Company under the mark Power Pack.

The drilling motor 12 will have associated therewith a power shaft 24 that is disposed within an outer housing member 26. The outer housing member 26 has an inner bore surface 28 that extends to a radial shoulder 30 which in turn extends to the outer surface 32. The power shaft 24 extends from the drilling motor 12 and due to its operation, the drilling motor 12 imparts rotation to the power shaft 24. As depicted in FIG. 2, the power shaft will be connected to the inner bit member 34. Thus, rotation of the power shaft 24 will in turn impart rotation to the inner bit member 34.

The power shaft 24 has a outer surface 36 that extends to the plurality of splines 38, with the splines being comprised on a radial shoulder 40. The radial shoulder 40 extends to the outer surface 42 which in turn extends to the radial shoulder 44. In the embodiment depicted in FIG. 2, the outer cylindrical surface 36 will also have a groove 46 that has placed therein a snap ring 48 for retaining the outer bit housing in place.

The outer surface 36 concludes at the radial shoulder 50 that in turn leads to the first inner bore surface 52 which then extends to the radial shoulder 54 and ultimately into the inner bore 56. The inner bore 56 is fluidly connected with the inner diameter of the work string 4 so that circulation of the drilling fluid is achieved via the inner bore 56.

The inner bit 34 is attached to the power shaft 24. In the preferred embodiment, the inner bit 34 is attached to the power shaft 24 via set screws and may be in hexagonal shape. It should be noted that a threaded shaft is an alternate embodiment. The female end of the shaft and the male end of the inner bit 34 will be four or six sided to transfer torque, and will be held in place with the set screws. The inner bit 34 generally comprises a radial shoulder 60 that abuts the shoulder 54. The radial shoulder 60 extends to the outer surface 62 that in turn leads to the radial surface 64. The radial surface 64 will then lead to the chamfered surface 66 which in turn stretches to the outer cylindrical surface 68. The cylindrical surface 68 terminates at the bit face 70. The bit face 70 will include thereon a plurality of cutters 72, which in the preferred embodiment will be diamond cutters. The bit face 70 is a partial spherical shaped member being similar in construction to the Polycrystalline Diamond Compacts (PDC) currently being used to drill some wells. A PDC type of bit is commercially available from Baker Hughes Inc. from the Hughes Christensen Division.

The inner bit 34 will contain an inner bore diameter 74 that is operatively associated with the inner bore 56 of the power shaft 24. The inner bore diameter has two passages, namely 76 and 78, for delivering the drilling fluid to the bit face 70. The drilling fluid will exit the inner bit 34 via passages 76, 78 into the nozzles (not shown). The nozzles aid in cleaning the bit face 70 as well as lifting cuttings as is well understood by those of ordinary skill in the art. The passage 76 will preferentially clean the bottom of the hole and inner bit, and passage 78 will preferentially clean the outer bit.

Also as seen in FIG. 2, the outer housing member 26 will have associated therewith the motor housing adapter 82. The motor housing adapter 82 will generally be a circular collar member having a radial end 84 that cooperates with the radial shoulder 30 of the outer housing member 26. In the preferred embodiment, the motor housing adapter 82 is retained via cap screws (not shown) to the motor housing 26. The radial end 84 extends to the outer cylindrical surface 86 that in turn concludes at the radial surface 88 that stretches to the inner bore surface 90. The motor housing adapter 82 will have extending therefrom the supports 92, 94 which are adapted to receive the pinions 96, 98. The supports 92, 94, in the preferred embodiment, will have attached at the second end the plate members 100, 102 with the plate members being provided to for lateral bracing of the supports 92, 94.

The thrust-type bearing assemblies 104, 106 have also been included. The thrust-type bearing assemblies 104, 106 will provide for transferring of the axial load to the motor housing 26 via the motor housing adapter 82 from the outer bit member 108. The thrust-type bearing assemblies 104, 106 may be a roller-bearing type that can allow the transfer of the load along with rotation of the outer bit member 108. The thrust-type bearing assemblies 104 may be a roller or ball bearings that are used to transfer the axial load. Thus, the weight from the outer bit housing 108 is transferred to the bearing assembly 104, 106, through the motor housing adapter 82 and onto the motor housing 26.

The outer bit member 108 will now be described. The outer bit 108 is concentrically placed about the inner bit member 34 and the outer bit member 108 will drill the outside portion of the hole. The outer bit member 108 will have a first inner bore 112 that extends to the shoulder 114 that in turn extends to a plurality of inner cogs 116/117, with the inner cogs 116/117 cooperating with the pinions 96, 98 to transfer rotation from the power shaft 24 to the outer bit member 108 so that a counter rotation is produced in the outer bit relative to the inner bit.

The inner cogs 116 lead to the shoulder 118 that in turn extends to the second inner bore 120 that concludes at the radial surface 122. The radial surface 122 leads to the third inner bore 124 that terminates at the radial shoulder 126 which in turn extends to the fourth inner bore 128. The fourth inner bore 128 will lead to the bit face 130 which is a partial spherical shaped member similar to bit face 70 that is concentrically arranged about the bit face 70. The bit face 130 will contain cutters 132, with the cutters being disposed in an opposite direction relative to the cutters 72 since the rotation of the bit face 130 is in an opposite direction.

Extending radially inward of the bit face 130 will be the outer surface 134 that extends to the chamfered surface 136 that in turn terminates at the outer surface 138. The outer surface 136 will conclude at the chamfered surface 140. As depicted in FIG. 2, a chamber 142 is formed from the cooperation between the power shaft 24/inner bit member 34 and the outer bit member 108. This chamber 142 will contain, in the preferred embodiment, a lubricant that will aid in the axial rotation of the bit 34 and bit 108.

A first sealing means 143 for sealing the chamber 142 from the drilling fluid that would be contained in the annulus area 22 of the bore hole is provided. The seal means 143 protects from contamination of the chamber 142. In one embodiment, the first sealing means 143 is an o-ring member fitted between the outer bit member 108 and the motor housing adapter 82. A second sealing means 144 for sealing the chamber 142 from the inner diameter 56 is provided, that in the embodiment shown of FIG. 2 will be fitted between the power shaft 24 and the inner bit member 34. A third sealing means 146 for sealing the chamber 142 from the passages 78 as well as the annulus 22 is also provided, that in the embodiment shown of FIG. 2 will be fitted between the outer bit member 108 and the inner bit member 34. Also included in the embodiment of FIG. 2 is the snap-ring member 145 that is fitted into the inner bit member 34, with the snap ring being used to hold the outer bit member 108 in place. An equalizer may also be included to equalize the pressure between the chamber 142 and annulus pressure 22.

Figure 3:
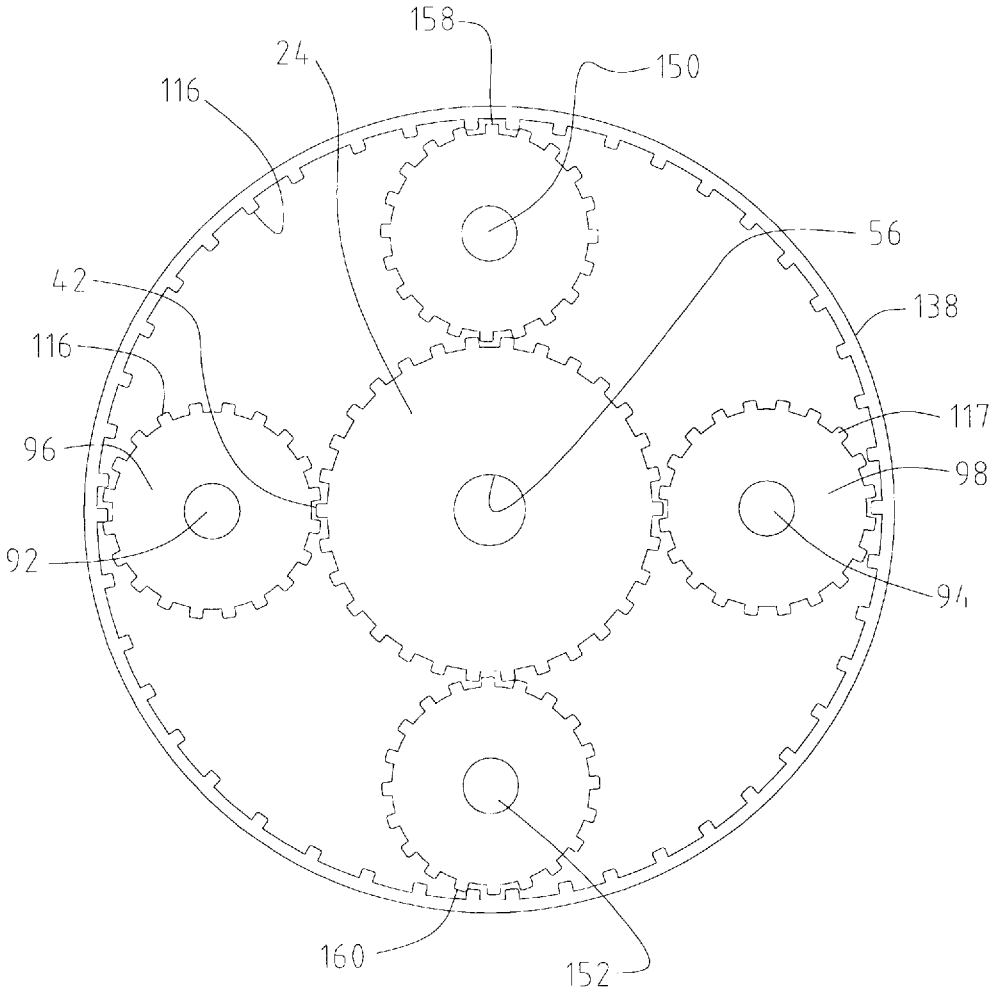
FIG. 3 is a cross-sectional view of the line A—A taken from FIG. 2.

Referring now to FIG. 3, a cross-sectional view of the line A—A taken from FIG. 2 is depicted. The power shaft 24, with the inner bore 56 disposed therein, is positioned with the gear assembly, with the planetary gear assembly adapted for imparting the rotation generated from the drilling motor 12 to the outer bit member 108. In other words, the planetary gear assembly transfer torque from the power shaft 24 to the outer bit member 108. The planetary gear comprises a plurality of outer bit cogs 116 formed on the inner bore 112 of the outer bit member 108 and a the pinions 96, 98 that are operatively associated with the 116 cogs. In the preferred embodiment, the pinions 96, 98 will engage the shaft cogs 42 so that rotative movement of the shaft cogs 42 is imparted to the cogs 116/117 of the pinions 96, 98.

In the preferred embodiment, the invention will also contain the support members 150, 152 that extend from the motor housing adapter 82. The support members 150, 152 will have the additional pinions 154, 156 that are received therein, with the pinions 154, 156 having the plurality of cogs 158, 160 respectfully. Thus, the rotation of the power shaft 24 in the counterclockwise phase will impart a clockwise rotation to the pinions (via engagement of shaft splines 42 with cogs 116) which will in turn effect clockwise rotation of the outer bit member 108 (via engagement of cogs 116 with cogs 116). It should be noted that the number of support members may vary depending on the size of the tool i. e. the larger tool will require more support members.

Figure 4:
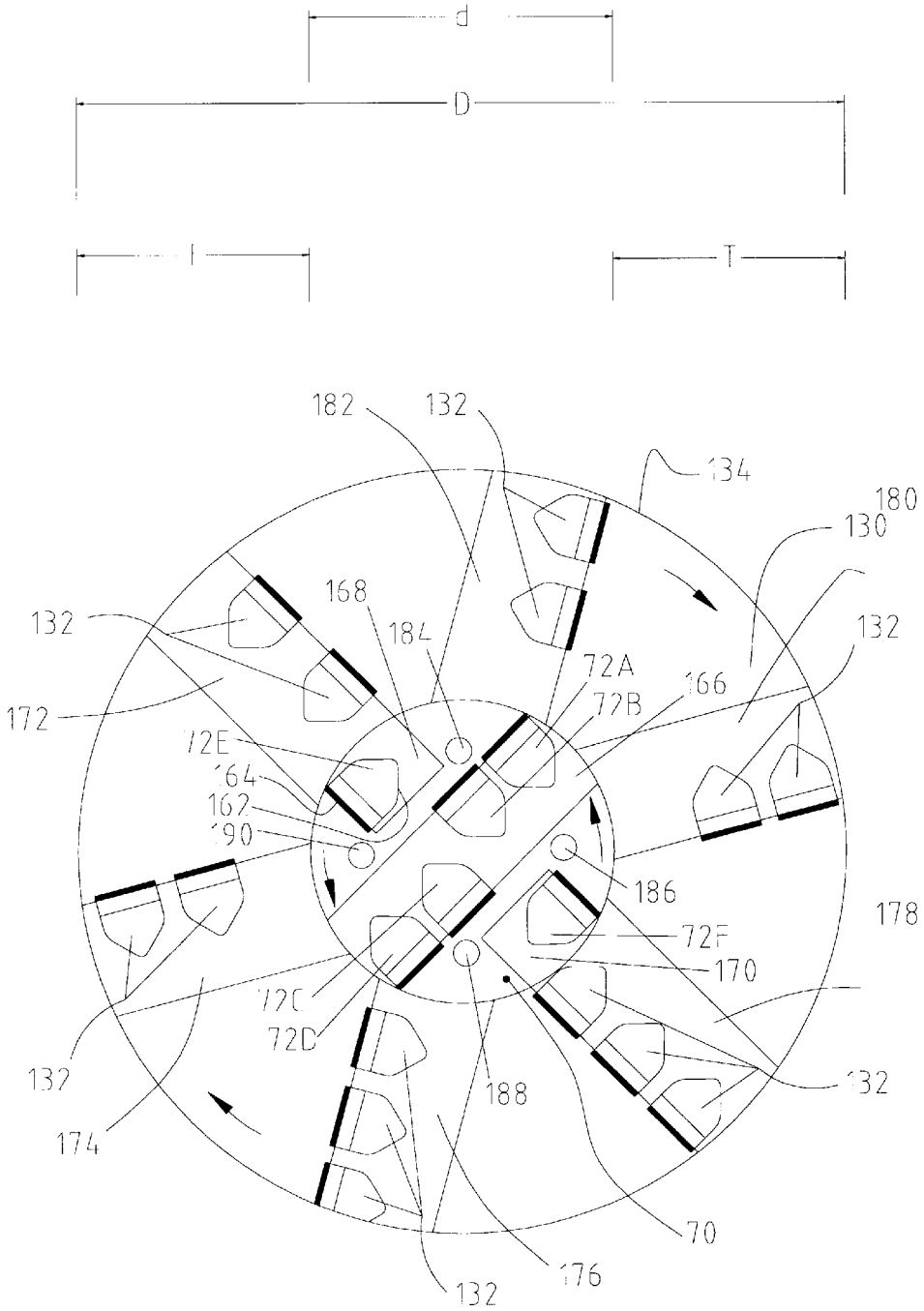
FIG. 4 is a perspective view of the novel bit faces.

Referring now to FIG. 4, a perspective view of the novel bit 10, and in particular, the inner bit face 70 and the outer bit face 130 is illustrated. Thus, the inner bit face 70 has a plurality of cutter blades 72 arranged so that in the counterclockwise rotation of the inner bit member 34, the cutter blades 72 bore the formation.

The cutter blades 72 are comprised generally of the housing 162 that have attached thereto the cutting faces 164, with the cutting face 164 containing the cutting material such as polycrystalline diamond for instance. The cutters and cutter blades are very generic and are common to the industry.

As depicted in FIG. 4, the inner bit member 34 has a first arm 166 that has contained thereon the cutter blades 72A, 72B, 72C, and 72D, with the first arm extending from the bit face 70. The cutter blades 72A and 72B are oriented in different directions since the counterclockwise rotation will be about the center axis. The inner bit member 34 will contain a second arm 168 and a third arm 170, with all arms extending from the bit face. The arm 168 contains the cutter blade 72E and the arm 170 contains the cutter blade 72F. In operation, the number of bit blades, the number of cutters, etc. will vary depending on a number of variables such as formation hardness, size of the hole, desired penetration rate, hole angle, pore pressure, etc.

The outer bit member 130 may contain a first arm 172, second arm 174, a third arm 176, a fourth arm 178, a fifth arm 180, and a sixth arm 182, with each arm containing cutter blades 132A–132M. As pointed out earlier, the cutter blades 132A–132M will be oriented so that a bore hole is drilled when the outer bit 130 is rotated via the gear assembly in a clockwise fashion. FIG. 3 also depicts the nozzles 184, 186, 188, and 190 which will clean the inner bit 70 as well as the outer bit 130. Also, in the preferred embodiment, cutter blades 72A–72D are generally offset with respect to the cutter blades 132A–132M i. e. the cutter blades 72A–72D extend past the cutter blades 132A–132M (this feature is shown in FIG. 2). Thus, after the initial 2 to three inches of rock are cut, both bits engage the rock at the same time with generally equal amount of weight applied. Also, in the preferred embodiment, two nozzles will be directed to clean the inner bit 34 and two nozzles will be directed to clean the outer bit 108.

Generally, in one embodiment, the area that the inner bit cuts will have to be generally equal to the area that the outer bit cuts. Thus, depending on the size hole being drilled, the specific diameter "d" of the inner bit 70 and diameter "D" of the outer bit 130 may be varied to meet the specifics of the hole dynamics. Also, area is but one component of the two bit diameters. Others include bit speed. For instance, since the inner bit will be turning roughly twice as fast as the outer bit due to the diameters of the shaft and the outer bit housing, the outer bit may have to cut twice as much as the inner bit.

Figure 5:
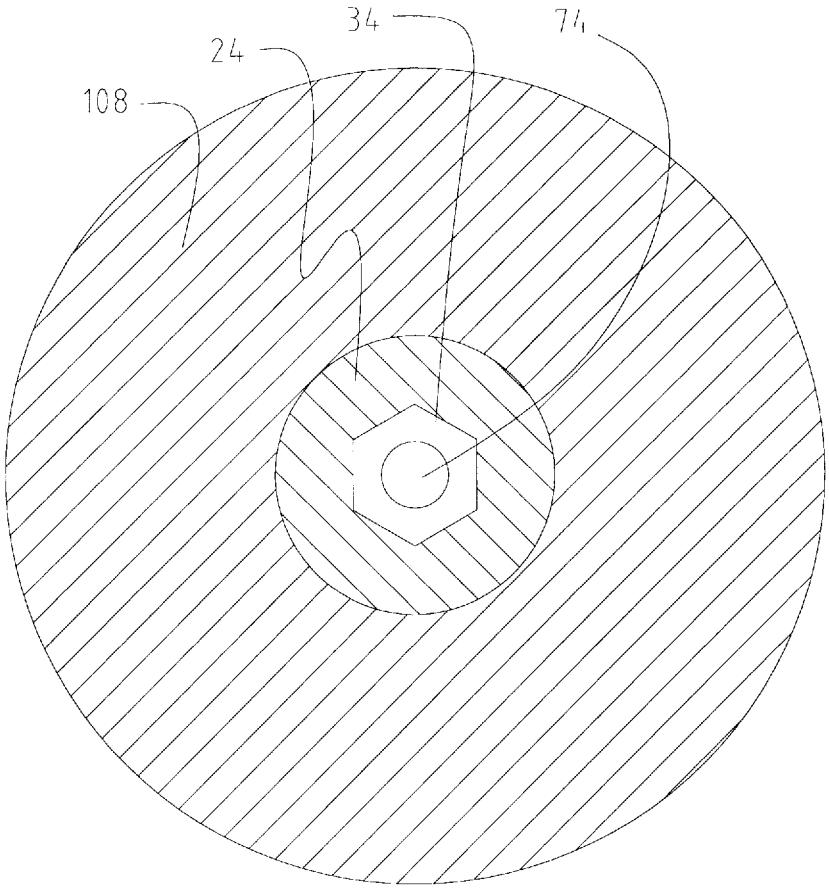
FIG. 5 is a cross-sectional view of the line B—B taken from FIG. 2.

Finally, FIG. 5 which a cross-sectional view of the line B—B taken from FIG. 2 depicts the hexagon shape of the inner bit member 34 is also depicted that transfers torque from the power shaft 24 to the inner bit 34. The set screws attaching the inner bit 34 to the power shaft 24 are not shown. In one embodiment, the inner bit 34 is sized with the outer bit 108 to perform at approximately the same work rate. For instance, in a 8.5 inch outer diameter "D" of the outer bit 108, the outer diameter "d" of the inner bit 34 is approximately 4.75 inches. The inner bit will be turning approximately two times as fast as the outer bit 108 due to the gear rations between the shaft and the outer bit 108.

Changes and modifications in the specifically described embodiments can be carried out without departing from the scope of the invention which is intended to be limited only by the scope of the appended claims.

I claim:

1. An apparatus for boring a well, the apparatus being attached to a tubular string, the tubular string having an inner bore for channeling a fluid, the apparatus comprising:

a first bit member having a first end and a second end, with the first end adapted to a motor member, said motor member being attached to the tubular string and having a power shaft that imparts rotation to said first bit member in a first radial direction, with the first bit member having an inner bore diameter that is in fluid communication with the inner bore of the tubular string and an outer diameter, and wherein said second end contains a semi-spherical first bit face with a first cutter element;

a second bit member concentrically arranged about said outer diameter of said first bit member, said second bit member having a first end and a second end, and wherein said second end contains a second semi-spherical bit face with a second cutter element;

a planetary gear adapted for imparting rotation from said motor member to said first end of said second bit member in a counter radial direction.

2. The apparatus of claim 1 further comprising a motor housing adapter, with the motor housing adapter having a first end and a second end, with the first end being attached to the motor member.

3. The apparatus of claim 2 further comprising:

a bearing assembly having a first end and a second end, with the second end of said motor housing being rotably associated with said first end of said bearing assembly so that rotation of said first bit member and said second bit member is facilitated.

4. The apparatus of claim 3 wherein said first bit member and said second bit member are adapted to form a cavity and wherein the apparatus further comprising:

a sealing means for sealing communication from said inner diameter of said first bit member into said cavity;

a lubricate compound placed within said cavity.

5. The apparatus of claim 4 wherein said first cutter element comprises:

a first set of cutter teeth contained on said semi-spherical first bit face and positioned to drill the bore hole in said first direction;

and wherein said second cutter element comprises;

a second set of cutter teeth contained on said semi-spherical second bit face and positioned to drill the bore hole in said counter direction.

6. The apparatus of claim 5 wherein said first bit member is offset relative to said second bit member so that said first bit member extends further into the bore hole relative to said second bit member.

7. The apparatus of claim 3 wherein said power shaft has a plurality of cogs thereon formed to cooperate with said planetary gear.

8. The apparatus of claim 7 wherein said planetary gear comprises:

a plurality of outer bit cogs formed on the inner diameter of said outer bit housing;

a first pinion operatively associated with said outer bit cogs and wherein said first pinion engages said shaft cogs so that rotative movement of said shaft cogs is imparted to said outer bit cogs.

9. The apparatus of claim 8 further comprising:

a second pinion operatively associated with said outer bit cogs;

a third pinion operatively associated with said outer bit cogs;

a fourth pinion operatively associated with said outer bit cogs;

and wherein said second pinion, third pinion, and fourth pinion engages said shaft cogs so that rotative movement of said shaft cogs is imparted to said outer bit cogs.

10. A device for drilling a well bore comprising:

a tubular string having a first end and a second end, said tubular string having an inner bore therethrough for delivering a fluid;

motor means, adapted to said second end of said tubular string, for generating a rotative force to a power shaft, said power shaft having a plurality of cogs;

an inner bit member adapted to said power shaft so that said inner bit is rotated in a first direction, with said inner bit member having an internal bore in fluid communication with said inner bore of said tubular string and an external diameter, said inner bit member having a first end adapted to said power shaft and a second end having a first semi-spherical bit face, said first semi-spherical bit face having a passage fluidity communicating with said internal bore of said tubular string;

an outer cylindrical bit member concentrically arranged about said external diameter of said inner bit member, and wherein said outer cylindrical bit member contains a first end and a second end, and wherein said second end contains a second semi-spherical bit face;

a planetary gear system adapted for imparting the rotation generated from said power shaft to said first end of said outer bit member in a second counter rotation.

11. The apparatus of claim 10 wherein said power shaft has a plurality of shaft cogs thereon formed to cooperate with said planetary gear system.

12. The apparatus of claim 11 wherein said planetary gear comprises:

a plurality of outer bit cogs formed on the inner diameter of said outer bit member;

a first pinion operatively associated with said outer bit cogs and wherein said first pinion engages said shaft cogs so that rotative movement of said shaft cogs is imparted to said outer bit cogs.

13. The apparatus of claim 12 further comprising:

a second pinion operatively associated with said outer bit cogs;

a third pinion operatively associated with said outer bit cogs;

a fourth pinion operatively associated with said outer bit cogs;

and wherein said second pinion, third pinion, and fourth pinion engages said shaft cogs so that rotative movement of said shaft cogs is imparted to said outer bit cogs.

14. The apparatus of claim 13 further comprising:

a bearing assembly having a first end and a second end, with the second end of said motor means being rotatingly associated with said first end of said bearing assembly.

15. The apparatus of claim 14 wherein said inner bit member and said outer bit member are adapted to form a chamber and wherein the apparatus further comprises:

a sealing means for sealing communication from said inner diameter of said first bit into said chamber;

a lubricate compound placed within said chamber.

16. The apparatus of claim 15 wherein said first semi-spherical bit face comprises:

a first set of cutter teeth positioned to drill the bore hole in the first direction relative to the bottom of the hole;

and wherein said second semi-spherical bit face comprises:

a second set of cutter teeth positioned to drill the bore hole in the second counter rotation relative to the bottom of the hole.

17. The apparatus of claim 16 wherein said first semi-spherical bit face is offset relative to said second semi-spherical bit face so that said first semi-spherical bit face extends further into the bore hole relative to said before said second semi-spherical bit face.

18. A planetary gear system for imparting rotation for drilling a bore hole comprising:

a motor member adapted for generating a rotative force to a power shaft, said power shaft having a plurality of shaft cogs formed thereon, said power shaft being operatively associated with a first partially spherical drilling member so that a first rotative movement is imparted to said first partially spherical drilling member;

a first pinion operatively associated with said shaft cogs;

a housing having an internal diameter and an external diameter, said housing being operatively associated with a second partially spherical drilling member, and wherein said second partially spherical drilling member is concentrically disposed about said first partially spherical drilling member;

a plurality of housing cogs formed on said internal diameter of said housing;

and wherein said first pinion transfers rotative movement from said shaft to said housing so that said housing rotates in a second counter rotative movement relative to said power shaft.

19. The planetary gear system of claim 18 further comprising:

a second pinion operatively associated with said shaft cogs; and wherein said power shaft exerts a reactive torque in a first direction and said housing exerts a reactive torque in an equal but opposite direction.

20. A method of drilling a well bore with a drilling assembly having a drilling motor with a power shaft extending therefrom, a drilling device, the drilling device including an inner bit and a concentric outer bit, and a gear assembly adapted for transferring rotation of said power shaft the method comprising:

rotating a power shaft from the drilling motor in a first direction;

imparting rotation to the inner bit in a first direction, said inner bit having a first partially spherical bit face;

drilling a segment of the well bore with said first partially spherical bit face;

creating a first reactive torque in the inner bit;

transferring the rotation of the power shaft to said gear assembly;

transferring the rotation of said gear assembly to said outer bit so that a counter rotation is produced, said outer bit containing a second partially spherical bit face;

drilling an enlarged segment of the well bore with said second partially spherical bit face;

creating a second reactive torque in the outer bit.

21. The method of claim 20 wherein said gear assembly includes a pinion having a spline members thereon, and a plurality of cogs located on the inner diameter of said concentric outer bit and wherein the step of transferring the rotation of the power shaft to said gear assembly includes:

engaging said power shaft with said pinion;

rotating said pinion;

and wherein the step of transferring the rotation of said gear assembly to said outer bit includes:

engaging said spline members of said shaft with said cogs of said concentric outer bit;

rotating said concentric outer bit.

22. The method of claim 21 wherein said first reactive torque created by the drilling of the bore hole with said inner bit is equal to the second reactive torque created by the drilling of the bore hole with said outer bit.

* * * * *